United States Patent [19]

James

[11] Patent Number: 5,031,708

[45] Date of Patent: Jul. 16, 1991

[54] COCKABLE COREBREAKER APPARATUS

[75] Inventor: Christopher A. James, North Bay, Canada

[73] Assignee: Longyear Company, Salt Lake City, Utah

[21] Appl. No.: 512,659

[22] Filed: Apr. 20, 1990

[51] Int. Cl.[5] ..... E21B 25/00

[52] U.S. Cl. ..... 175/251; 175/333; 175/404

[58] Field of Search ..... 175/333, 404, 245, 249, 175/251, 252

[56] References Cited

U.S. PATENT DOCUMENTS

| | | | |
|---|---|---|---|
| 643,082 | 2/1900 | Bullock | 175/251 |
| 648,920 | 5/1900 | Bullock | 175/251 |
| 790,331 | 8/1904 | Terry | 175/239 |
| 1,663,096 | 3/1928 | Phipps | 175/249 |
| 1,720,700 | 7/1929 | Stone | 175/234 |
| 1,773,171 | 8/1930 | Copelin | 175/249 |
| 1,848,453 | 3/1932 | Zublin et al. | 175/254 |
| 2,490,512 | 12/1949 | Deely | 175/239 |
| 2,522,399 | 9/1950 | Pickard | 175/255 |
| 2,829,868 | 4/1958 | Pickard et al. | 175/255 |
| 3,340,939 | 9/1967 | Lindelof | 175/246 |
| 3,428,138 | 2/1969 | Casper et al. | 175/255 |
| 3,540,537 | 11/1970 | Brown | 175/251 |

*Primary Examiner*—Ramon S. Britts
*Assistant Examiner*—Roger J. Schoeppel
*Attorney, Agent, or Firm*—Clayton R. Johnson

[57] ABSTRACT

Disclosed herein is a drill stem having a core bit mounted thereon and an inner tube assembly having an inner tube mounting a corebreaker case that either has or in conjunction with the inner tube provides a corebreaker recess having an upwardly facing planar edge. Advantageously a stop ring and a non-axial split annular corebreaker are mounted in the recess with the stop ring being between the corebreaker and inner tube, even though the corebreaker may be axially slit and/or no stop ring used. The corebreaker has inner and outer peripheral surfaces that are of constant diameters, axial opposite transverse inner and outer planar edges while the recess is in part defined by planar edges. At least one of the parallel edges is inclined to the tube central axis when the core breaker is in its core taking position. The corebreaker is cockably movable between a datum position that its axis is inclined relative to the case axis for breaking a core and retaining the broken-off core in the inner tube as being retrieved, and the core taking position that the corebreaker axis is coextensive with or parallel to the central axes of the bit, inner tube and the corebreaker case to permit the core extending thereinto.

22 Claims, 2 Drawing Sheets

COCKABLE COREBREAKER APPARATUS

BACKGROUND OF THE INVENTION

This invention relates to core drilling apparatus that has a corebreaker mounted in a core lifter case for limited movement relative thereto for breaking a core and retaining the core in an inner tube as the inner tube is retracted to the drilling surface.

In U.S. Pat. No. 1,720,700 to Stone there is disclosed one embodiment of a non-axial slit core lifter ring that has an exterior surface that in addition to being circular relative to its central axis is rounded in an axial direction (rounded in a direction perpendicular to its circular curvature about its central axis). The lower shoulder of the recess in which the core lifter is mounted has a high point to cause tilting of the core lifter when the inner tube assembly is retracted. Due to the axial rounding of the ring surface the core lifter can prematurely rotate about horizontally extending axes prior to starting the core taking operation and also increases production costs. Such premature rotation, at times may create a condition blocking the desired entrance of core into the core lifter and/or may have excess rotation during withdrawal and allow slippage of the core in the lifter with possible loss of core. It appears the upper and lower annular edges of the ring are parallel relative to one another. U.S. Pat. No. 790,331 to Terry discloses one embodiment of a cockable core lifter having an exterior surface similar to that of Stone and a second embodiment that has a frustoconical exterior surface.

U.S. Pat. No. 3,540,537 to Brown discloses a core lifter case that has a gradually tapered axial inner surface and a resilient split steel ring having a smooth cylindrical, transverse inner surface that extends substantially the axial length of the core lifter. The central axis of the core lifter, the inner tube and the core lifter case are equally radially spaced from the lifter radial inner surface. Further the core lifter has a smooth, transverse outer axial conical surface of a taper to form a mating fit with the above mentioned surface of the case and a smooth cylindrical, transverse inner surface; and axially opposite axially outwardly and inwardly opening slots that open to the respective terminal edge of the core lifter.

U.S. Pat. No. 2,490,512 to Deely discloses a core lifter case having a frustoconical recess in which a corebreaker is mounted for limited axial movement. The first embodiment of the corebreaker that has a top annular edge that is axially spaced from the lower edge of the inner tube and inclined relative thereto when no core extends into the lifter, is inclined upwardly relative to its lower annular edge, is axially split and is movable while core is being taken to have its upper edge extend horizontally. Thus when the core lifter moves from its datum position to the position its upper edge is horizontal, the lifter moves to have the lifter axis oppositely inclined relative to the central axis of the drill bit from that when the lifter was in its datum position. The exterior and lower part of the interior surface of the core lifter are of frustoconical shapes and the upper interior surface is cylindrical, the inner surface being toothed. U.S. Pat. No. 1,848,453 to Zublin et al shows additional forms of cockable core lifters in a drill bit.

U.S. Pat. No. 3,428,138 to Capser et al discloses offset core lifter apparatus having a core lifter case with an annular groove that has an inner edge that is inclined relative to the central axis of the core barrel inner tube.

SUMMARY OF THE INVENTION

The corebreaker case and inner tube provide an annular recess in part defined by an annular shoulder and a terminal edge respectively parallel to one another with a corebreaker in the recess being in the form of a non-axial split ring of a thin wall construction and having exterior and interior circular cylindrical peripheral surfaces and axial opposite annular edges with one edge being inclined relative to the other.

An object of this invention is to provide a new and novel corebreaker of a simple construction and inexpensive to manufacture while being effective for breaking core and retaining core in the inner tube while the core is being retrieved.

DESCRIPTION OF THE PREFERRED EMBODIMENT

For purposes of facilitating the description of the invention, the term "inner" refers to that portion of the drill stem, or of the assembly, or an element being described which in its position "for use" in the drill stem is located closer to the core bit on the drill stem than any other portion of the apparatus being described, except where the term clearly refers to a transverse circumference, direction or diameter of the drill stem or other apparatus being described. The term "outer" refers to that portion of the drill stem, or of the assembly, or element being described which in its position "for use" in the drill stem is Iocated closer to the mouth of the drill hole than any other portion of the apparatus being described, except where the term clearly refers to a transverse circumference, direction or diameter of the apparatus being described.

Figure 1:
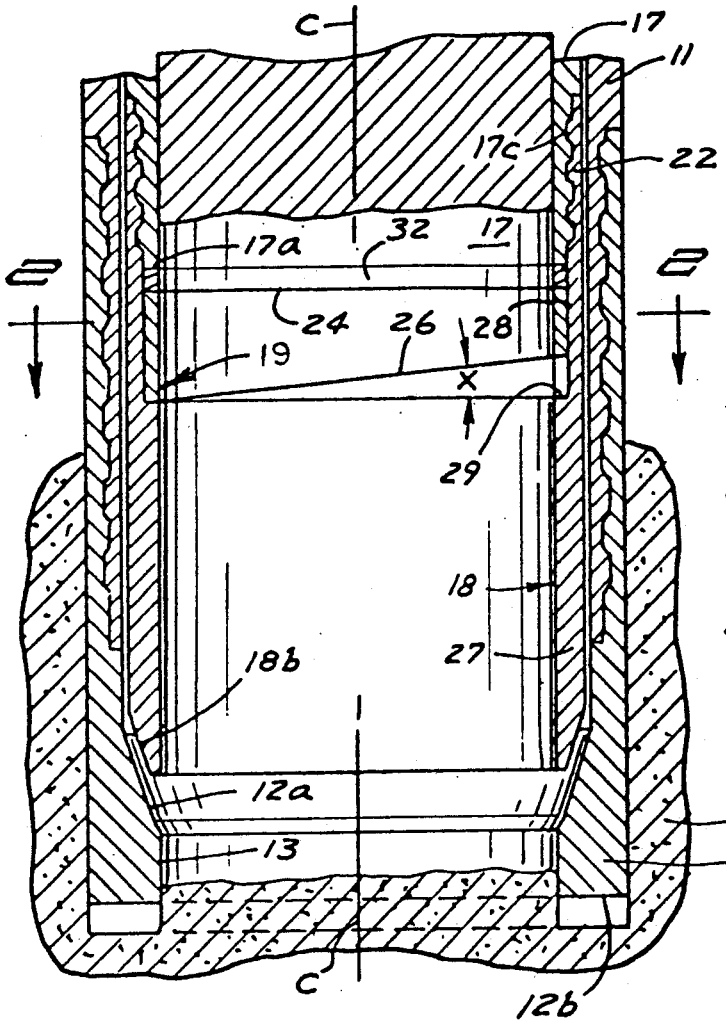
FIG. 1 is a fragmentary longitudinal cross sectional view of the inner axial end of the drill stem and core barrel inner tube, together with the corebreaker apparatus of the first embodiment of this invention attached to said tube and shown in its position that core is extended therethrough, an axial intermediate portion of the core broken away.
Figure 4:
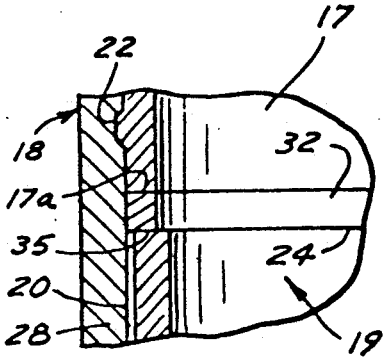
FIG. 4 is an enlarged fragmentary cross sectional view of a portion of the apparatus of FIG. 1 with the corebreaker in its core taking position and the annular clearance between the corebreaker and the corebreaker case being exaggerated.
Figure 2:
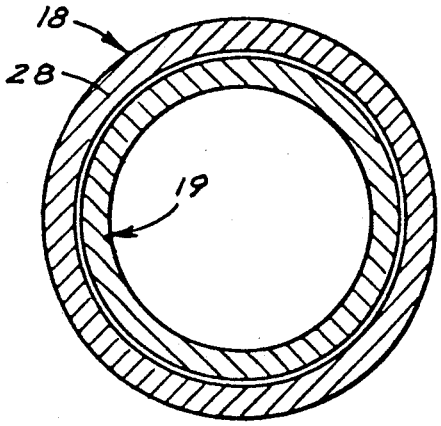
FIG. 2 is a transverse cross sectional view generally taken along the line and in the direction of the arrows 2—2 of FIG. 1, the annular clearance space between the corebreaker and corebreaker case being exaggerated.

Referring now to FIG. 1, there is illustrated the inner end portion of a drill stem 11 extended into a bore hole in the earth formation 14, the portion iIlustrated constituting a portion of what is frequently referred to as the core barrel outer tube. To the inner end of the drill stem there is threadedly connected a rotary core bit 12 that is rotated by the drill stem to drill a core. The core bit has a central aperture I3 that is provided for boring the core in the earth formation 14. Located within the drill stem in a position to receive core as it is being drilled is a core barrel inner tube assembly having a core barrel inner tube 17, a core lifter case (corebreaker case) of the first embodiment, generally designated 18, being threadedly connected to the inner axial end of the inner tube and a corebreaker of the first embodiment, generally designated 19, cockably retained in the corebreaker case. It is noted that the only portion of the core barrel inner tube assembly illustrated is the inner axial end of the inner tube, the corebreaker case, the stop ring and the corebreaker; however, it is to be understood the core barrel inner tube assembly can be of a wire line type that is retractable through a drill stem, the core barrel inner tube assembly disclosed in U.S. Pat. No. 2,829,868 being one example of such type; or a core barrel inner tube assembly that is not retractable independent of the drill stem, U.S. Pat. No. 2,522,399 being on example of this type.

The outer end of the corebreaker case 18 has internal threads 22 that form a matching fit with the external threads of the core receiving tube. The case has a lower minimum inner diameter portion 27 and an axial intermediate portion 28 of a larger inner diameter that opens to the inner portion 27 to form an annular shoulder 29 that faces outwardly and is located inwardly of the case threaded portion 22. The terminal inner end (edge) 17*a* of the inner tube, the shoulder 29 and part of the inner peripheral wall of case portion 28 defines a recess 20 in which the corebreaker is mounted. The inner peripheral wall of portion 28 is of a substantially constant inner diameter throughout its axial length to provide a circular cylindrical surface having a central axis aligned with the drill bit, core lifter case and core receiving tube central axes C—C. The inner annular edge 17*a* of the inner tube and the shoulder 29 are contained in parallel planes perpendicular to the central axes.

The core receiving tube 17 has an axial inner, exteriorily threaded end portion 17*c* that has edge 17*a* and forms a mating fit with the internal threads 22 of the corebreaker case. The corebreaker case has an axial terminal edge abutable against a downwardly facing shoulder of the core receiving tube to limit the threaded movement of the corebreaker case onto the inner tube and thereby determine the axial length of the recess 20.

A conventional stop ring 32, advantageously of the same construction as more fully set forth in U.S. Pat. No. 3,340,939, is mounted in the recess 20 axial between the corebreaker and the axial inner terminal inner tube edge 17*a*. The stop ring is circular cylindrical and has its central axis coextensive with the axis C—C when the stop ring is seated in the recess in abutting relationship to the inner tube edge 17*a*. Although the corebreaker may be used without providing a stop ring, in view of the much greater wear or other damage to the inner edge portion of the inner tube that would occur during usage than if the stop ring were not provided; and the expense of replacing the inner tube being much greater than that of the stop ring, it is highly preferred that a stop ring be provided in the recess 20.

The corebreaker is non-slotted, non-axial split and has inner and outer circular cylindrical walls of constant diameters throughout their axial lengths. The outer diameter of the corebreaker is of a slightly smaller diameter than the inner diameter of case portion 28, the difference in diameters being sufficient to permit the cocking movement that will be further described below. The corebreaker axial outer annular edge 24 lies in a plane perpendicular to the central axis of the core lifter while the axial opposite inner annular edge 26 lies in a plane inclined at an angle to the central axis, for example about 78° to 88° relative to the central axis and advantageously about 83°. Thus when the stop ring, if provided, has it axial edges abutting against the edges 17*a* and 24 respectively and parallel thereto, the corebreaker edge 26 extends relative to the transverse plane of shoulder 29 at an included acute angle X of about 2 to 12 degrees (see FIG. 1). At this time the central axis of the corebreaker is coextensive with the central axis C—C or parallel and closely adjacent thereto due to the small difference between the outer diameter of the corebreaker and the inner diameter of case portion 28. Each of the edges 24, 26 extends angularly through 360° in the respective edge plane, i.e. have no slots.

The corebreaker outer diameter is only slightly smaller than the minimum diameter of the threads of case portion 22, i.e. preferably just enough to permit the corebreaker being axially insertthough the outer end of the corebreaker case to be positioned to be seated on shoulder 29. Further, the outer diameter of the corebreaker is sufficiently greater than the inner diameter of the inner tube and the stop ring, if provided, so that the corebreaker has an annular, radial outer edge portion abutting against the shoulder 29 when the corebreaker is in its datum position (core breaking and core retrieving positions of FIG. 3) while the axial outermost edge portion 35 of annular edge 24 abuts against the stop ring or is minimally spaced therefrom to permit the corebreaker to move between the positions of FIGS. 1 and 3. That is, preferably the maximum axial dimension of the corebreaker relative to the axial spacing of the inner edge of the stop ring to the shoulder is of a minimal spacing while permitting the corebreaker moving between its datum position and its core taking position of FIG. 1 when the stop ring abuts against the inner tube edge 17*a* and extends parallel thereto.

The inner diameter of the corebreaker is slightly larger than that of the minimum inner diameter of the core bit whereby the core can readily pass through the corebreaker, and at the time there is provided enough drag resulting from the tendency of the corebreaker to remain in its datum position, the corebreaker will move (pivot or tilt) relative to the corebreaker case to or closely adjacent to the position shown in FIG. 1.

The structure of the apparatus of the first embodiment this invention having been described, the use thereof will now be set forth. For purposes of facilitating the description of the operation of the apparatus of this invention, it will be assumed that the drill stem is extended into a bore hole in an earth formation in a generally downward direction and a core barrel inner tube assembly is located in the drill stem in a position to receive core during the drilling operation. At this time the corebreaker is in its datum position of FIG. 3. Now the drill stem is moved axially inwardly to have the core bit face 12*b* abut against the annular groove in the earth formation and the core drilling operation is started whereby the cutting of core is begun. Because of the annular shape of the core bit, an ever deepening hole is cut with a rod like core being produced. As the drilling continues, the drill stem, including the core bit, move relative to the core whereby the core extends through the core bit aperture and thence into the core lifter case to be radially adjacent to the corebreaker case inner surface. As the axial length of the core increases, the corebreaker case moves downwardly relative to the core until the corebreaker edge 26 abuts against the core to result in the corebreaker pivotally tilting (cockably moving) in the general direction of arrow 38 about the edge portion 36 of edge 26 that is axially opposite edge portion 35 and thence move the corebreaker downwardly along the core such that the core extends through the corebreaker. Further tilting movement is blocked by the corebreaker abutting against the stop ring with edge 24 parallel to the stop ring adjacent edge, it being noted that the stop ring and corebreaker are of relative dimensions that the radial outer annular portion of the axial outer edge 24 abuts against a radial inner annular portion of the axial inner edge of the stop ring when the stop ring and corebreaker are in their positions of FIG. 1 with or without core being extended thereinto. It is to be understood that the corebreaker remains in its datum position until it is moved therefrom. The corebreaker has its maximum axial length portion extending between edge portion 35, 36 of edges 24, 26 respectively and a diametrically opposite minimum axial length portion extending edge portion 37 of edge 26 and edge portion 40 of edge 24.

Figure 3:
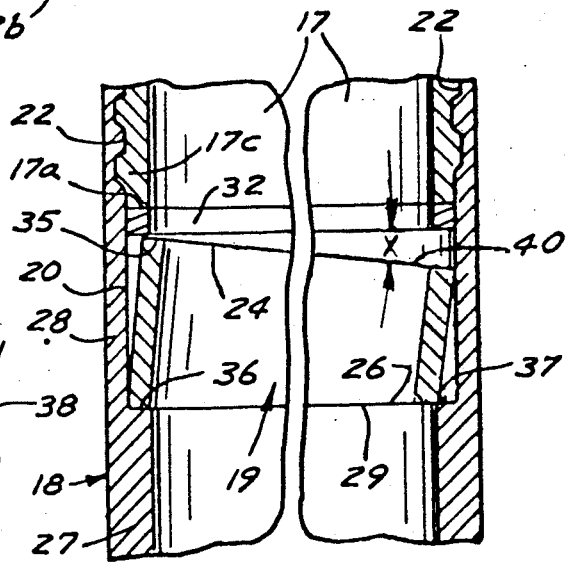
FIG. 3 is a fragmentary view of the structure of FIG. 1 with the corebreaker in its datum position and the radial intermediate position broken away.

Normally in conventional core drilling apparatus, particularly of the type for deep hole drilling, a core barrel inner tube assembly is connected to a swivel (not shown) so that the rotary motion of the drill stem is not imparted to the core barrel inner tube but rather the inner tube and corebreaker case usually only move axially relative to the core as the drill stem is rotated After the core of desired length has been cut, for example, when a high pressure signal is provided at the surface through conventional structure, the drilling is stopped and the drill stem is pulled outwardly a short distance. Pulling the drill stem outwardly results in the drill stem moving axially outwardly relative to corebreaker case until surface 12*a* of the bit abuts against the case surface 18*b*, provided appropriate conventional type of core drilling is used whereby the corebreaker case is normally retained out of contact with the core bit. Assuming the corebreaker case is movable relative to the drill stem in the above manner, after surfaces 12*a*, 18*b* are in abutting relationship, further axially outward movement of the drill stem results in the corebreaker case moving axially relative to the core and the corebreaker whereby through the drag of the corebreaker on the core, the corebreaker case moves relative to the corebreaker and pivotally tilts relative to the corebreaker case in the direction opposite arrow 38, i.e. the corebreaker cocking to deflect and subsequently break the core. That is, the cocking movement results in corebreaker edge portion 35 biting into the core and edge portion 37 also biting into the core at a radial opposite, axially lower position than that of portion 35 to provide a generally diagonal stress fracture. Accordingly the core is broken away from the earth formation and at least the corebreaker edge portion 35 abuts against the lower diagonal edge portion of the separate core and the frictional resistance of the corebreaker radially and axially spaced from edge portion 35, movement of the separated core relative to the corebreaker is prevented. As is depicted in FIG. 3, when the corebreaker is in its datum position, the edge portion 35 of the corebreaker extends further radially inwardly than the axial adjacent parts of the stop ring and inner tube and the axially opposite edge portion 37 likewise extends further radially inwardly of the axially adjacent parts of the stop ring and the core lifter case.

Not previously mentioned, preferably when the stop ring is in its seated position abutting against the inner edqe of the inner tube, its inner diameter is substantially the same as that of the inner tube.

The corebreaker case and corebreaker when they have their central axes aligned provide a straight through bore creating an unobstructive bore for the core to pass through, the core causing the corebreaker to move such that axes of the case and breaker are at least substantially coextensive. Additionally due to the corebreaker in its datum position having its inner edge abutting against and parallel to shoulder 29 premature rotation and cocking movement of the corebreaker does not take place.

The dimensions set forth below are not to be considered as a limitation on the invention, but rather as an example of one embodiment For example the outer diameter of the corebreaker is about 0.08" smaller than the inner diameter of case portion 28 for a corebreaker case having an outer diameter of about 2.2". The corebreaker case also has a minimum inner diameter of about 1.95" and portion 28 has an inner diameter of about 2.05". The corebreaker has a maximum height of about ¾", a minimum height of about ½", an diameter of about 1.88" and an outer diameter of about 2.03" with the radial wall thickness being about 0.15"; and the inner diameter of the inner tube being about 1.95". The inner diameter of the stop ring in its seated position shown in FIG. 1 is substantially the same as that of the inner tube.

Figure 5:
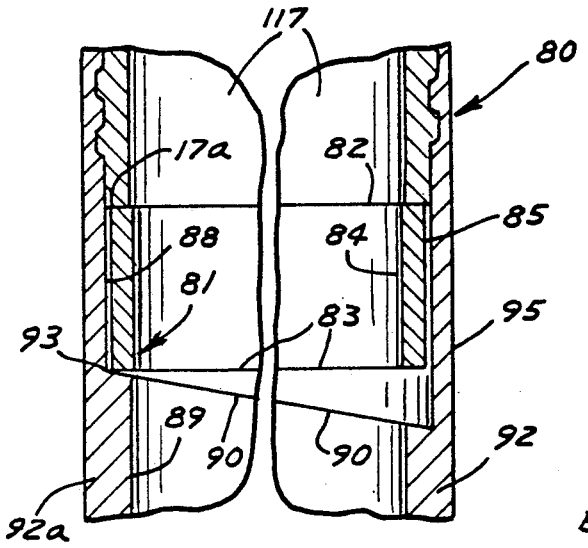
FIG. 5 is a view of corebreaker apparatus similar to that shown in FIG. 1, other than it shows a second embodiment of this invention.

Referring to FIG. 5, the second embodiment of this invention, generally designated 80, includes a core lifter case 92 that is same as that of the first embodiment except that it has inclined, axially outward facing shoulder (annular edge) 90 instead of the edge 29. That is, from the highest point 93 of the edge 90, edge 90 is inclined downwardly at about 2 degrees to 12 degrees from the horizontal when the case central axis is vertical; whereas the lower terminal edge 17*a* of the inner tube lies in a horizontal plane. The inner peripheral surface 88 of the axial intermediate portion 95 of the case is circular cylindrical from edge 90 to at least the inner tube terminal edge 17*a* and has its central axis coextensive with the inner tube central axis, i.e. of a constant inner diameter throughout its axial length. The juncture of the intermediate portion 95, which has surface 88, with the axial inner portion 92*a* of the corebreaker (opening of the intermediate portion to the axial inner portion) defines the shoulder 90, the radial inner surface 89 of portion 92*a* and the radial inner surface 88 of portion 95 having central axes that are coextensive. The radial inner diameter of portion 92*a* is substantially smaller than the inner diameter of portion 95.

The non-axial slit corebreaker, generally designated 81, of the second embodiment has concentric, circular cylindrical radial inner and outer, constant diameter peripheral surfaces 84, 85 respectively that extend axially from the axial outer terminal annular edge 82 to the inner terminal annular edge 83. The axially opposite edges 82, B3 are parallel to one another and perpendicular to the corebreaker central axis. The outer surface 85 of the core breaker is sufficiently smaller than the diameter of surface 88 of the recess that the corebreaker can cockably move from a core taking position that its edge 82 abuts against and is parallel to edge 17*a* and a datum core breaking position that edge 83 abuts against and extends parallel to edge 90 of the case. The inner diameters of the inner tube, corebreaker and the core lifter case of the second embodiment correspond to one another in the same manner that the inner diameters of the inner diameters of the inner tube, corebreaker and core lifter case of the first embodiment correspond relative to one another. Further the central axis of radial inner and outer surfaces of the corebreaker when the corebreaker is in its core taking position of FIG. 5 is coextensive with or parallel to the central axis of the corebreaker and the core receiving tube.

Even though the second embodiment does not include a stop ring, advantageously a stop ring may be used axially between the inner tube edge 17*a* and the breaker edge 82 by having the axial dimensions of surface 88 of appropriate dimensions so that the corebreaker of the second embodiment will function in the same manner as the first embodiment.

Figure 6:
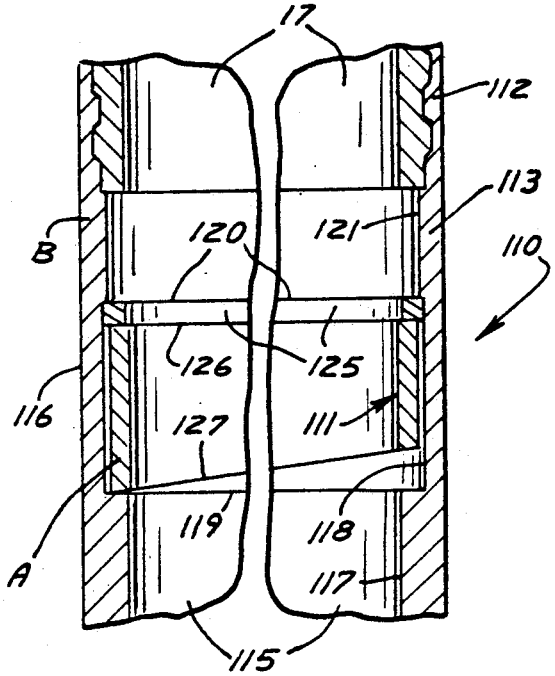
FIG. 6 is a view that corresponds to FIG. 1 other than it is of the third embodiment of this invention.

Referring to FIG. 6, the third embodiment, includes a core lifter case (corebreaker case), generally designated 110 and a non-axial slit corebreaker, generally designated 111. The core lifter case includes an axial inner portion 115 having a transverse inner peripheral surface 117, an axial intermediate portion 116 having an inner peripheral surface 118 opening to portion 115 to form an upwardly facing planar shoulder (annular edge) 119 that is perpendicular to the corebreaker case central axis, an axial intermediate portion 113 axial opposite portion 116 from portion 115 and having a radial inner surface 121 and a threaded portion 112 that opens to portion 113 axial opposite to portion 116. The inner diameter of portion 115 is smaller than each of portions 116, 113 and 112 while the inner diameter of portion 113 is smaller than the diameter of each of portions 116 and the minimum diameter of the threaded portion 112. Portion 113 opens to portion 116 to form the downwardly facing, planar shoulder or annular edge 120 that is parallel to edge 119.

The shoulders 119, 120 and the case wall defining the constant surface 118 form an annular recess in the core lifter case within which the corebreaker 111 and the annular, axially split stop ring 125 are mounted. The inner diameter of the stop ring when mounted in the case recess is larger than the inner diameter of the corebreaker, while its outer diameter is larger than the inner diameters of portion 113 and the outer diameter of the corebreaker. The outer diameter of the corebreaker is advantageously only slightly smaller than the inner diameter of portion 113 to allow the corebreaker to be moved axially inwardly through the case to abut against the shoulder 119 and is larger than the inner diameter of the case inner portion 115 to limit the inward movement of the corebreaker lifter to its core breaking datum position. The stop ring which is advantageously slit to facilitate being mounted in the case recess, serves to retain the corebreaker in the recess, the stop ring being located axially between the corebreaker and the intermediate portion 113 of the corebreaker case. The axial opposite annular edges of the stop ring are parallel to one another. The axial outer, planar annular edge 126 of the corebreaker 111 lies in a plane perpendicular to the central axis of the corebreaker while the axial opposite, planar inner annular edge 127 lies in a plane inclined downwardly relative to the horizontal at an angle to the case central axis, for example about 2° to 12° relative to the central axis and advantageously about 7°. The axial dimensions of the corebreaker case recess between the stop ring and edge 119 and of the corebreaker 111 relative to one another correspond to those of the same dimensions of the same parts of the first embodiment to permit the corebreaker moving between its corebreaker position that edge 127 abuts against and is parallel to edge 119 and its core taking position that edge 126 abuts against and is parallel to the stop ring. Thus the manner of use of the third embodiment is the same as the first embodiment.

Figure 7:
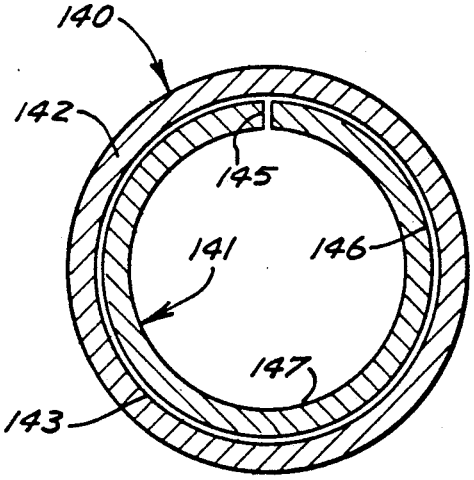
FIG. 7 is a transverse cross sectional view of a modified embodiment of any one of the first three embodiments.

Even through it is preferable the corebreaker be non-axially slit as described with reference to each of the above described three embodiments, it is to be understood that instead of a non-axially slit corebreaker being used, an axially slit core lifter may be used and desirable, for example, in other than downward direction core drilling. Thus the transverse cross section of the fourth embodiment of the corebreaker case recessed portion and the corebreaker shown in FIG. 7 may be of any one of the first three embodiments, these members being shown in concentric, core taking positions and looking axially inwardly and taken axially between the annular edges defining the recess. The fourth embodiment includes a corebreaker case, generally designated 140, that includes an axial intermediate portion 142 having a recess that in part define by the recess radial inner peripheral surface portion 143 of the case; the corebreaker 141 having a slit 145 that extends axially between its axial opposite annual edges (not shown). Further the corebreaker has inner and outer peripheral, constant diameter surfaces 147, 146 respectively that are circular cylindrical from the breaker one terminal annular edge to the other, i.e. circular cylindrical throughout there entire axial length.

With the third embodiment incorporating the corebreaker of the fourth embodiment, the third embodiment may be further modified by have the corebreaker case portions 113, 115 of the same inner diameters that in turn are smaller than the outer diameter of the corebreaker 141, which may be made of spring steel, in its relaxed condition while the stop ring in the recess has transverse inner and outer diameters to retain the corebreaker in the case recess during a core taking operation.

It is the applicants understanding that it is possible using special manufacturing operations to make the third embodiment wherein the inner diameter of case portion 113 of the same inner diameter as portion 115 and the outer diameter of the corebreaker being larger than the inner diameters of portions 113, 115. However at the present time such manufacturing operations are very expensive.

As to each of the embodiments of the corebreakers, the corebreakers may be used with or without stop rings, provided the cylinder peripheral surface of the recess in which the corebreaker is to be mounted is of appropriate axial dimensions. Further, if no stop ring were used, the inner terminal edge of the inner tube and at least one of the annular edges of the corebreaker of, for example, the first embodiment may be appropriately inclined such that in the core taking position, the corebreaker outer edge would be parallel to and abut against the thus modified inner tube terminal edge, and in the datum position the corebreaker would have its central axis inclined such as is the situation with the illustration in FIG. 3. The transverse inner and outer surface of all the embodiments of the core breaker of this invention are of substantially constant diameters at least substantially the entire, if not the entire, axial length of the corebreaker, are circular cylindrical with a common central axis, and are void of axially extending slots (contrasted to the axial slit of the slitted embodiments) that open through either of the axially opposite terminal edges. Additionally, each of the embodiments with either slit or non-slit corebreakers when the corebreakers are in their core taking positions with their central axes coextensive with the respective core lifter case central axis, are of maximum outer diameters to provide a small, annular radial clearance between the corebreaker and the core breaker case or inner tube edge 17*a* that in part defines the recess throughout the axial length of the corebreaker. Also the axial opposite terminal edges of each embodiment of the corebreaker and the annular edges of the corebreaker that define a part of the case recess are planar.

Although not preferred, the second embodiment may have its edge 90 planar and perpendicular to the case central axis at the axial innermost part of edge 90 as shown except for an axial outwardly extending generally rectangular case protrusion extending through an angle of, for example less than about 10°, and having an appropriately downwardly inclined transverse top surface to abut against the edge 83 to permit cockable movement of the corebreaker to its inclined corebreaking position such as would occur if the edge portion 90 had not been thus modified. Thus, in the core breaking position one edge portion of the corebreaker would seat on the inclined portion of the protrusion and the diametric opposite portion on the axial inner parallel part of the axial inner case shoulder. The inner diameter of the protrusion would be the same as the axial inner portion of the case while its its radial outer portion would be integral with the case wall portion that defines the corebreaker recess.

What is claimed is:

1. Core drilling apparatus for attachment to an inner end portion of an axially elongated core receiving tube that has a central axis of elongation and a transverse planar, axial inner annular edge, comprising an axially elongated corebreaker case having a central axis and an outer end part adapted for connection to the inner end portion of the core receiving tube to have its central axis extend coextensive with the tube central axis, the case having wall means defining an axial outer bore portion in the outer end part and an inner bore portion of a smaller inner diameter than the inner diameter of outer bore portion and opening thereto to form a generally planar transverse annular outwardly facing shoulder perpendicular to the case central axis and that in cooperation with the inner tube inner edge define a corebreaker recess, a non-axial split annular corebreaker mounted in said recess for limited movement relative to the corebreaker case between a core breaking position and a core taking position and having a central position, the core breaker having an axial inner and outer peripheral walls that are of substantially constant inner and outer diameters respectively throughout their axial lengths, an axial outer, transverse annular planar edge substantially perpendicular to the corebreaker central axis and a transverse, axial inner, substantially planar edge that is inclined relative to the corebreaker central axis and abuttable against the shoulder, the outer diameter of the corebreaker being sufficiently less than the inner diameter of the outer bore portion to permit the corebreaker being cockably moved from the core breaking position that the corebreaker inner edge abuts against said shoulder and extends parallel relative thereto to a core taking position that the corebreaker outer edge is parallel to said shoulder, and the corebreaker central axis is one of extending coextensive with the corebreaker case central axis and parallel to the corebreaker case central axis, and the corebreaker being of an outer diameter greater than the inner diameters of the core receiving tube and the corebreaker case inner portion to retain the corebreaker in the recess when the corebreaker case is connected to the core receiving tube.

2. The core drilling apparatus of claim 1 further characterized in that the angle of inclination of the corebreaker central axis relative to the corebreaker inner edge in an axial outer direction is within a range of about 78 to 88 degrees.

3. The core drilling apparatus of claim 1 wherein a stop ring is mounted the recess in abutable relationship to the corebreaker axial outer edge, the stop ring having generally planar, axially opposite edges perpendicular to the corebreaker central axis.

4. The core drilling apparatus of claim 3 further characterized in the corebreaker has a maximum axial length portion and a diametric opposite minimal axial length portion, the axial length of the recess being substantially the same as the combined axial lengths of the stop ring and the maximum length portion and sufficiently great to permit the above cockable movement of the corebreaker.

5. The core drilling apparatus of claim 1 further characterized in that the corebreaker is of an inner diameter smaller than the inner diameters of the corebreaker case inner bore portion and that when the corebreaker has its outer edge extending parallel to the shoulder, the corebreaker inner edge extends at an angle of about 2 to 12 degrees to the shoulder.

6. The core drilling apparatus of claim 5 further characterized in that corebreaker case has an internally threaded portion extending axially outward of the recess of a minimum internal diameter sufficiently great to have the corebreaker moved axially inwardly to seat on said shoulder and that the recess is of a constant diameter throughout its axial length.

7. Core drilling apparatus for retrieving a core that is axially outwardly, retractable extended into a bore hole, comprising a drill stem having an inner end portion, a drill bit having a central axis, and a bore extending axially therethrough and being threadedly mounted on the drill stem inner end portion, an axially elongated core receiving tube extending axially in the drill stem and having a central axis of elongation and an axially inner externally threaded end portion that has a transverse planar, axial inner terminal annular edge, at least one of drill stem and core barrel receiving tube being retractable in an axial outward direction, an axially elongated corebreaker case having a central axis and an axially outer, internally threaded end part threadedly connected to the inner end portion of the core receiving tube to have its central axis extend coextensive with the tube central axis, the case having wall means defining an axial outer bore portion in the outer part and an inner bore portion of a smaller inner diameter than the inner diameter of outer bore portion and opening thereto to form a generally planar transverse annular outwardly facing shoulder perpendicular to the case central axis and that in cooperation with the receiving tube inner edge defines a corebreaker recess that is of a constant diameter throughout its axial length, non-axial split, annular corebreaker means mounted in said recess for limited cockable movement relative to the corebreaker case between a first position to move downwardly relative to a core in surrounding relationship thereto and a cocked second position to break a core when an outward force is exerted on the corebreaker case, the corebreaker means having a central axis, axial inner and outer peripheral circular cylindrical walls that are of substantially constant inner and outer diameters respectively throughout their axial lengths, an axial outer, transverse annular planar edge substantially perpendicular to the corebreaker central axis and a transverse, axial inner, substantially planar edge axially spaced from the means outer edge, the outer diameter of the corebreaker being sufficiently less than the inner diameter of the outer bore portion to permit the corebreaker means being cockably moved from the first position that the corebreaker outer edge extends parallel to the receiving tube terminal edge to the second position that the corebreaker means inner edge abuts against said shoulder, and an outer diameter greater than the inner diameters of the core receiving tube and the corebreaker case inner portion to retain the corebreaker means in the recess.

8. The core drilling apparatus of claim 7 further characterized in that a stop ring that is mounted in the recess axially abutable against the inner tube terminal edge and the corebreaker means and has an inner diameter larger than the inner diameter of the corebreaker means and axially opposite planar edges parallel to the inner tube central axis.

9. The core drilling apparatus of claim 8 further characterized in the drill bit bore is of a slightly smaller diameter than the inner diameter of the corebreaker means and that the corebreaker means inner diameter is smaller than the inner diameters of each of the inner diameters of the core receiving tube and the corebreaker case inner portion.

10. The core drilling apparatus of claim 9 further characterized in that the corebreaker means inner edge is inclined relative to the corebreaker means central axis, and to the shoulder at an angle of inclination of about 2 to 12 degrees when the corebreaker means is in its first position.

11. The core drilling apparatus of claim 10 further characterized in that said angle of inclination is about 7 degrees and that the corebreaker means is of an outer diameter slightly smaller than that of the recess to permit the corebreaker means moving between its positions.

12. The core drilling apparatus of claim 10 further characterized in that the axial length of the recess is only slightly greater than the combined axial length of the stop ring and the maximum axial length of the corebreaker means.

13. Core drilling apparatus adapted for attachment to an inner end portion of an axially elongated core receiving tube that has a central axis of elongation and a generally transverse, axial inner annular portion to break a core and retain the core in the receiving tube as the receiving tube is withdrawn from a bore hole, comprising an axially elongated core lifter case having a central axis and an outer end part adapted for connection to the inner end portion of the core receiving tube to have its central axis extend coextensive with the tube central axis, the case having wall means defining an axial outer bore portion in the outer end part and an inner bore portion of a smaller inner diameter than the inner diameter of outer bore portion and opening thereto to form a generally transverse annular first edge that defines an outwardly facing shoulder, at least one of the receiving tube annular portion and the core lifter case having a generally planar transverse annular second edge axially outwardly of the annular first edge and facing in an axial direction opposite that of the annular first edge, the case outer bore portion having a transverse, inner surface portion of a constant inner diameter axially from the annular first edge to the annular second edge and equally radially spaced from the corebreaker case central axis throughout its axial length to in conjunction with the annular first and second edges cooperatively define a corebreaker recess, a generally annular corebreaker mounted in said recess for limited movement relative to the corebreaker case, and having a central axis, axial inner and outer peripheral walls that are of substantially constant inner and outer diameters respectively throughout at least substantially all of their axial lengths and throughout their constant diameter lengths are respective equally spaced from the corebreaker central axis, a transverse, axial outer, substantially annular planar third edge and a transverse, axial inner, annular fourth edge, the corebreaker being mounted in the recess for movement relative to the core lifter case between a cocked first position that the annular third edge has at least the major portion of its transverse peripheral dimension out of abutting relationship with the annular second edge and out of parallel relationship with the second edge, and a core taking second position that the third edge is in parallel relationship to the second edge, at least one of the first through fourth annular edges being sufficiently inclined relative the corebreaker central axis when the annular second and third edges are out of parallel relationship that the corebreaker axis is inclined relative to a plane perpendicular to the core lifter case axis, and that when the corebreaker in its first position, the corebreaker is adapted to break a core while the receiving tube is being withdrawn from the bore hole, the corebreaker in its second position having its central axis being one of coextensive with the core lifter case central axis and parallel to the core lifter case central axis, the outer diameter of the corebreaker in the recess being sufficiently less than the inner diameter of the outer bore portion to permit the corebreaker being cockably moved from the corebreaker second position to have the core extended therethrough to its first position to retain the core in the inner tube when the core lifter case is connected to the core receiving tube and sufficiently larger than the inner bore portion to abut against the annular first edge to retain the corebreaker in the recess when the case is connected to the inner tube and is being withdrawn, and of an inner diameter smaller than the inner diameter of the case inner bore portion, the diameter of the recess being sufficiently larger than the corresponding dimension of the corebreaker outer peripheral wall to permit the corebreaker moving between it positions, including moving to have an annular clearance space between the corebreaker and the case wall means, and limiting means including at least in part the annular second edge for limiting axial outward movement of the corebreaker in the recess to a position that the third edge is parallel to the second edge.

14. The apparatus of claim 13, further characterized in that the corebreaker is axially slit and in its relaxed position in the recess is of a maximum diameter that is less than the maximum diameter of the recess to provide an annular clearance between the corebreaker and the core lifter case when the corebreaker and corebreaker central axes are coextensive.

15. The apparatus of claim 13 wherein the tube annular portion comprises an axial inner tube terminal edge, further characterized in that the limiting means includes the receiving tube edge and a stop ring interposed axially between the corebreaker and the receiving tube edge, and that the corebreaker is void of an axial slit.

16. The apparatus of claim 13, further characterized in that the first edge is generally planar, and that when the corebreaker is in its core taking position, the second and third edges are parallel to one another and the fourth edge is inclined axially inwardly at an angle of about two to twelve degrees to the first edge.

17. The apparatus of claim 13, further characterized in that the fourth edge is generally planar, and that when the corebreaker is in its core taking position, the second, third and fourth edges are parallel to one another and the first edge is inclined at an angle of about two to twelve degrees to the fourth edge.

18. The apparatus of claim 13 wherein the tube annular portion comprises an axial inner tube terminal edge, further characterized in that the core lifter case has the annular second edge and a transverse annular fifth edge that is adapted to abut against the receiving tube edge when the case is connected to the tube to limit the axial outward movement of the case relative to the receiving tube when the case is connected to the receiving tube, the fifth edge being axially outwardly of the annular second edge.

19. The apparatus of claim 18, further characterized in that the corebreaker is void of an axial slit and when in its core taking position with its central axis coextensive with the case axis, the corebreaker is of an outer diameter such that the core breaker is radially spaced from the axially adjacent outer bore portion to provide an annular clearance space radially between the breaker and the case that extends the axial length of the corebreaker.

20. The apparatus of claim 18, further characterized in that said limiting means comprises a stop ring having axially opposite planar axially inner and outer edges located in the recess axially between the corebreaker and the annular second edge, the inner diameter of the stop ring being larger than the inner diameter of the corebreaker and larger than the inner diameter of the inner bore portion, the case having the annular second edge abutable against the stop ring axial outer edge.

21. The apparatus of claim 20 further characterized in that one of the annular first and fourth edges being the inclined edge and that the core lifter case axially between the annular second and fifth edges is of an inner diameter is slightly larger than the outer diameter of the corebreaker and the inner diameter of the stop ring being smaller than the outer diameter of the corebreaker.

22. Core drilling apparatus adapted for attachment to an inner end portion of an axially elongated core receiving tube that has a central axis of elongation and an axial inner annular portion to break a core and retain the core in the receiving tube as the receiving tube is withdrawn from a bore hole, comprising an axially elongated core lifter case having a central axis and an outer end part adapted for connection to the inner end portion of the core receiving tube to have its central axis extend coextensive with the tube central axis, the case having wall means defining an axial outer bore portion in the outer end part and a inner bore portion of a smaller inner diameter than the inner diameter of outer bore portion and opening thereto to form a generally transverse annular first edge means that defines an outwardly facing shoulder, at least one of the receiving tube annular portion and the core lifter case having a generally transverse annular second edge means axially outwardly of the annular first edge means and facing in an axial direction opposite that of the annular first edge means, the case outer bore portion having a transverse, inner surface portion of a constant inner diameter axially from the annular first edge means to the annular second edge and equally radially spaced from the corebreaker case central axis throughout its axial length to in conjunction with the annular first and second edge means cooperatively define a corebreaker recess, an annular corebreaker mounted in said recess for limited movement relative to the corebreaker case, and having a central axis, axial inner and outer peripheral walls that are of substantially constant inner and outer diameters respectively throughout at least substantially all of their axial lengths and throughout their constant diameter lengths are respective equally spaced from the corebreaker central axis, a transverse, axial outer, substantially annular third edge means and a transverse, axial inner, substantially annular fourth edge means, the corebreaker being mounted in the recess for movement relative to the core lifter case between a core breaking first position that the annular fourth edge means is in abutting relationship to the annular first edge means and a core taking second position that the annular fourth edge means has at least substantially its entire continuous peripheral angular surface portion of its transverse peripheral dimension out of abutting relationship with the annular first edge means, at least one of the first and fourth edges means having a portion abutting against the other to limit the axial inward movement of the corebreaker relative to the case that the corebreaker axis is inclined relative to a plane perpendicular to the core lifter case axis that when the corebreaker in its first position, the corebreaker is adapted to break a core while the receiving tube is being withdrawn from the bore hole, the corebreaker in its second position having its central axis one of being coextensive with the core lifter case central axis and parallel to the core lifter case central axis, the outer diameter of the corebreaker in the recess being sufficiently less than the inner diameter of the outer bore portion to permit the corebreaker being cockably moved from the corebreaker second position to have the core extended therethrough to its first position to retain the core in the receiving tube when the core lifter case is connected to the core receiving tube and sufficiently larger than the inner bore portion to abut against the annular first edge means to retain the corebreaker in the recess when the case is connected to the receiving tube and is being withdrawn, and of an inner diameter smaller than the inner diameter of the case inner bore portion, and means including at least in part the second edge means for limiting axial outward movement of the corebreaker in the recess.

* * * * *